US009913498B2

(12) United States Patent
Ichiba et al.

(10) Patent No.: US 9,913,498 B2
(45) Date of Patent: Mar. 13, 2018

(54) GARMENT WITH CUPS

(71) Applicant: WACOAL CORP., Kyoto (JP)

(72) Inventors: Aya Ichiba, Kyoto (JP); Asako Yasui, Kyoto (JP); Mariko Kanazawa, Kyoto (JP)

(73) Assignee: WACOAL CORP., Kyoto (JP)

( * ) Notice: Subject to any disclaimer, the term of this patent is extended or adjusted under 35 U.S.C. 154(b) by 217 days.

(21) Appl. No.: 14/780,694

(22) PCT Filed: Mar. 13, 2014

(86) PCT No.: PCT/JP2014/056771
§ 371 (c)(1),
(2) Date: Sep. 28, 2015

(87) PCT Pub. No.: WO2014/156700
PCT Pub. Date: Oct. 2, 2014

(65) Prior Publication Data
US 2016/0050983 A1 Feb. 25, 2016

(30) Foreign Application Priority Data
Mar. 29, 2013 (JP) ..... 2013-073213

(51) Int. Cl.
*A41C 3/10* (2006.01)
*A41C 3/14* (2006.01)
*A41C 3/08* (2006.01)

(52) U.S. Cl.
CPC ..... *A41C 3/14* (2013.01); *A41C 3/08* (2013.01); *A41C 3/10* (2013.01); *A41C 3/142* (2013.01)

(58) Field of Classification Search
CPC .. A41C 3/00; A41C 3/10; A41C 3/142; A41C 3/04
(Continued)

(56) References Cited

U.S. PATENT DOCUMENTS 3,067,751 A * 12/1962 Steiner ..... A41C 3/00 450/65
3,396,729 A * 8/1968 Glick ..... A41C 3/142 450/52
(Continued)

FOREIGN PATENT DOCUMENTS

GB 1 447 533 A 8/1976
JP 4510594 B2 5/2010
(Continued)

OTHER PUBLICATIONS

Extended European Search Report issued in European Patent Application No. 14775226.5 dated Oct. 26, 2016.
(Continued)

*Primary Examiner* — Gloria Hale
(74) *Attorney, Agent, or Firm* — Morgan, Lewis & Bockius LLP

(57) ABSTRACT

The present invention provides a garment with cup sections, which can lift up entire breasts to a higher position and thus can attain improved breast-shaping properties. The garment with cup sections according to the present invention includes: a pair of cup sections 101; and a back section 103. The back section 103 is arranged on lateral sides of the pair of cup sections 101. Each of the cup sections 101 includes an upper breast retaining section 105 arranged between a front-center-side upper edge portion and a lateral-side upper edge portion on an inner side of the cup section 101. The upper breast retaining section 105 is formed so as to cover at least part of an upper breast region positioned obliquely upward to a lateral side relative to a nipple and apply a pressing force to the part.

8 Claims, 13 Drawing Sheets

(58) Field of Classification Search
USPC ..... 450/60, 62, 65, 66, 74–76
See application file for complete search history.

(56) References Cited

U.S. PATENT DOCUMENTS

| | | | | | |
|---|---|---|---|---|---|
| 3,699,971 | A * | 10/1972 | Hittel | A41C 3/0028 | 450/3 |
| 3,896,818 | A * | 7/1975 | Locascio | A41C 3/00 | 450/70 |
| 4,444,191 | A | 4/1984 | Harned | | |
| 4,444,192 | A * | 4/1984 | Stern | A41C 3/00 | 450/67 |
| 5,037,348 | A | 8/1991 | Farino | | |
| 6,755,717 | B2 * | 6/2004 | Smith | A41C 3/0057 | 128/869 |
| 8,075,368 | B2 * | 12/2011 | Puyaubreau | A41C 3/0057 | 450/65 |
| 2003/0134567 | A1 | 7/2003 | Smith | | |
| 2014/0017977 | A1 | 1/2014 | Horii et al. | | |

FOREIGN PATENT DOCUMENTS

| | | | |
|---|---|---|---|
| JP | 2012-214916 | A | 11/2012 |
| JP | 2012-214961 | A | 11/2012 |
| JP | 2013-023796 | A | 2/2013 |
| WO | 2004/049839 | A1 | 6/2004 |

OTHER PUBLICATIONS

International Search Report issued in corresponding International Patent Application No. PCT/JP2014/056771 dated Jun. 3, 2014.

* cited by examiner

GARMENT WITH CUPS

TECHNICAL FIELD

The present invention relates to a garment with cup sections.

BACKGROUND ART

Some conventional garments with cup sections, such as a brassiere, are configured so that pads, support members, or the like are provided on the inner side (the side to be in contact with the skin of a wearer) of cup sections, in order to lift up breasts to achieve an improved bust silhouette. For example, Patent Document 1 proposes a women's garment with cup sections, including stretchable support members arranged on the inner side of the cup sections. Each of the stretchable support members is arranged so as to extend from the front center side to the lateral side via the lower side of the cup section. The lateral-side upper edges of the support members are held up by shoulder straps. The lower edges of the support members are attached to cup wire sections on the lateral side and the front center side of the cup sections. In an intermediate portion between these attachment positions, the support members are released from both the cup wire sections and the cup sections.

CITATION LIST

Patent Document(s)

Patent Document 1: Japanese Patent No. 4510594

SUMMARY OF THE INVENTION

Problem to be Solved by the Invention

However, conventional garments with cup sections, including the one disclosed in Patent Document 1, lift up breasts by pushing up the breasts from below. Thus, such conventional garments have a problem in that they only cause portions of the breasts pushed by members for lifting up breasts, such as the above-described support members, to be deformed, and it is difficult to lift up the entire breasts to a higher position. In particular, breasts that have become pendulous with advancing age are deflated and lack fullness in upper parts of the breasts (hereinafter also referred to as "upper breasts"). Even if such pendulous breasts are pushed up from below, it is difficult to provide fullness in the upper breasts. On this account, it is more difficult to lift up the entire pendulous breasts to a higher position.

With the foregoing in mind, it is an object of the present invention to provide a garment with cup sections, which can lift up entire breasts to a higher position and thus can attain improved breast-shaping properties.

Means for Solving Problem

In order to achieve the above object, the present invention provides a garment with cup sections, including: a pair of cup sections; and a back section, wherein the back section is arranged on lateral sides of the pair of cup sections, each of the cup sections includes an upper breast retaining section arranged between a front-center-side upper edge portion and a lateral-side upper edge portion on an inner side of the cup section, and the upper breast retaining section is formed so as to cover at least part of an upper breast region positioned obliquely upward to a lateral side relative to a nipple and apply a pressing force to the part.

Effects of the Invention

With the above-described configuration, the garment with cup sections according to the present invention can lift up entire breasts to a higher position and thus can attain improved breast-shaping properties.

MODE FOR CARRYING OUT THE INVENTION

Figure 20:
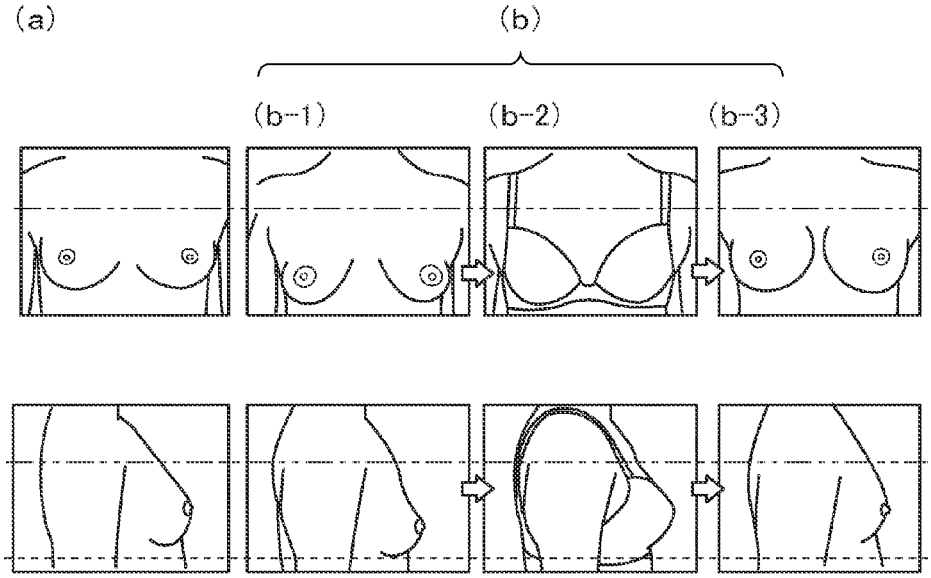
FIG. 20 shows drawings for comparing non-pendulous breasts of a woman in her 20's [(a)] with pendulous breasts of a woman in her 40's to 50's [(b)].

The inventors of the present invention conducted diligent studies in order to find a way to lift up entire breasts to a higher position. FIG. 20 show drawings for comparing non-pendulous breasts of a woman in her 20's with pendulous breasts of woman in her 40's to 50's. In FIG. 20, (a) shows the non-pendulous breasts in a naked state. In FIG. 20, (b) shows the pendulous breasts, in which (b-1) shows the pendulous breasts in a naked state, (b-2 shows the pendulous breasts wearing a brassiere, and (b-3) shows the pendulous breasts in water. The brassiere shown in (b-2) is a conventional brassiere having a function of pushing up breasts. In each of (a) and (b-1) to (b-3), the upper row shows the breasts viewed from the front, and the lower row shows the breasts viewed from the side. In FIG. 20, a two-dot chain line indicates the position of the third rib. Also, in FIG. 20, a dashed line is inserted to assist comparison of the positions of the breasts.

First, comparison of the naked states revealed that, in (a) of FIG. 20, the breasts have fullness at a high position, and gentle swelling is formed from above the vicinity of the third rib, whereas, in (b-1) of FIG. 20, the breasts have fullness at a lower position, and lack fullness in the upper breasts. Also, it can be seen that the breasts in (b-1) are at a lower position as compared with the breasts shown in (a). Next, with reference to (b-2), it can be seen that the breasts wearing the brassiere look rounder than the breasts in the naked state shown in (b-1). However, the breasts shown in (b-2) lack fullness in the upper breasts as compared with the breasts shown in (a). Besides, the position of the breasts remains low. From these results, it can be seen that the conventional brassiere can not lift up the entire breasts.

On the other hand, with reference to (b-3) in FIG. 20, it can be seen that, in water, the entire breasts are lifted up, whereby fullness is provided in the upper breasts and the position of the breasts is made high. As a result, the breasts in water have a similar silhouette to the breasts shown in (a) in FIG. 20. From these results, the inventors of the present invention found out that even pendulous breasts can show a silhouette similar to that of non-pendulous breasts of a woman in her 20's, when the pendulous breasts are in water. On the basis of this finding, the inventors of the present invention conducted in-depth studies to find out a way to allow pendulous breasts to have a silhouette similar to that in water.

Figure 22:
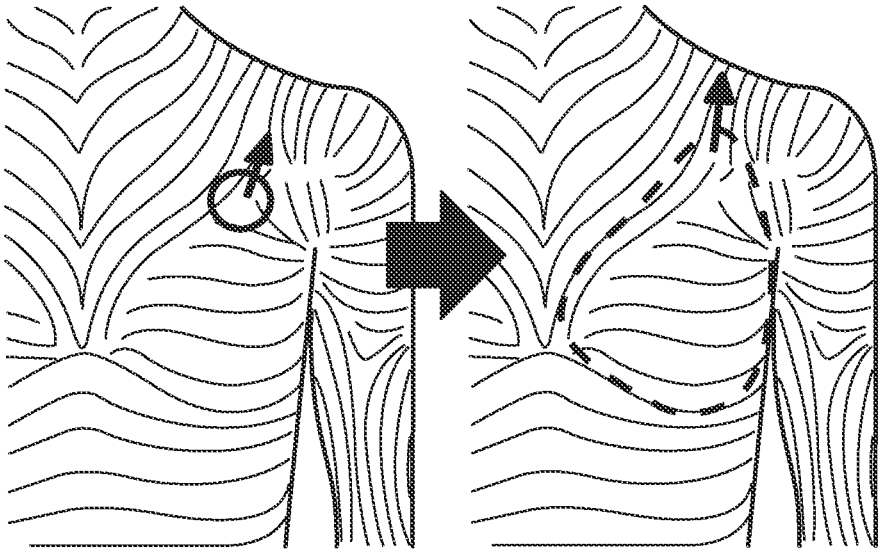
FIG. 22 schematically shows Langer's lines on a body.

The inventors of the present invention focused on the constitution of Langer's lines (skin cleavage lines) around breasts shown in FIG. 22. As indicated with a circle on the left in FIG. 22, it can be seen that there is a point at which a Langer's line extending from the front center side of a breast meets a Langer's line extending from the lateral side of the breast. The inventors of the present invention found out through trial and effort processes that pushing the skin around the above-described meeting point upward can produce an effect of lifting the entire breasts (a portion surrounded by dashed line on the right side FIG. 22) upward.

Figure 21A:
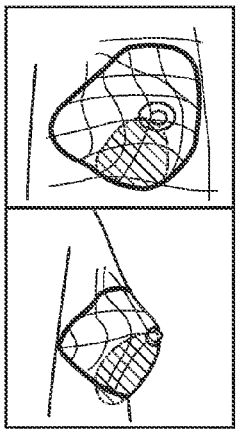
FIGS. 21A and 21B are drawings for illustrating a method for attaining a bust silhouette similar to that obtained in water.
Figure 21B:
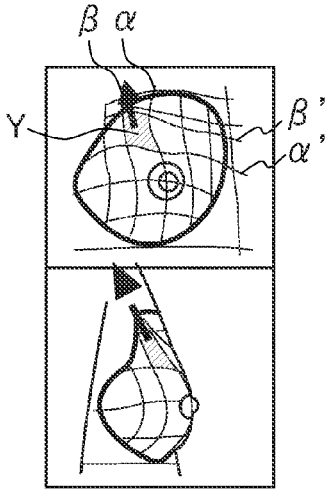

FIG. 21 shows drawings for illustrating a method for attaining a bust silhouette similar to that in water. FIGS. 21A and 21B show the pendulous breasts shown in FIG. 20 with lines forming a latticed pattern of 3 centimeters square being drawn thereon. In each of FIGS. 21A and 21B, the upper row is a perspective view of the breasts viewed from the front, and the lower row shows the breasts viewed from the side. First, as shown in FIG. 21A, when the breasts were pushed up according to a conventional manner of pushing up breasts from below, only the pushed-up portion (encircled with a two-dot chain line in FIG. 21A) of the breasts was deformed greatly, whereby, on the upper breast side, fullness was provided only above the pushed-up portion and in the vicinity thereof. Thus, the entire breasts could not be shaped effectively. In contrast, as shown in FIG. 21B, when upper parts of the breasts were lifted upward, the entire breasts were lifted up, so that the fullness could be shifted to a higher position. As a result of the studies, the inventors of the present invention discovered that it is possible to lift up entire breasts effectively by applying an upward force to, in particular, at least part of the following region in an upper part of each breast: a region (a hatched region Y in FIG. 21B) surrounded by a first virtual vertical line $\alpha$ passing through a nipple, a second virtual vertical line $\beta$ extending parallel to the first virtual vertical line $\alpha$ at a distance of 3 cm from the first virtual vertical line $\alpha$ on the lateral side of the first virtual vertical line $\alpha$, a first virtual horizontal line $\alpha'$ extending above the nipple at a distance of 3 cm from the nipple, and a second virtual horizontal line $\beta'$ extending above the first virtual horizontal line $\alpha'$ at a distance of 3 cm from the first virtual horizontal line $\alpha'$. This region Y corresponds to a region around the meeting point of the Langer's lines shown on the left in FIG. 22.

On the basis of the above-described finding, the inventors of the present invention also conducted the same examination with regard to a region Y' defined by a first virtual horizontal line $\alpha'$ extending above the nipple at a distance of 2 cm from the nipple, a second virtual horizontal liner extending above the first virtual horizontal line $\alpha'$ at a distance of 4 cm from the first virtual horizontal line $\alpha'$, and the same first virtual vertical line $\alpha$ and the second virtual vertical line $\beta$ as those for defining the region Y. As a result, it was found out that the above-described effect of lifting up the entire breasts also can be obtained in this case. This region Y' also corresponds to a region around the meeting point of the Langer's lines shown on the left in FIG. 22.

The inventors of the present invention thus found out that entire breasts can be lifted up to a higher position by applying an upward force directly to upper parts of the breasts, thereby achieving the present invention.

The garment with the cup sections according to the present invention will be described below with reference to illustrative examples. It is to be noted, however, that the present invention is by no means limited to or restricted by the following examples. In FIGS. 1 to 22 to be described below, the same parts and components are given the same reference numerals.

First Embodiment

Figure 1:
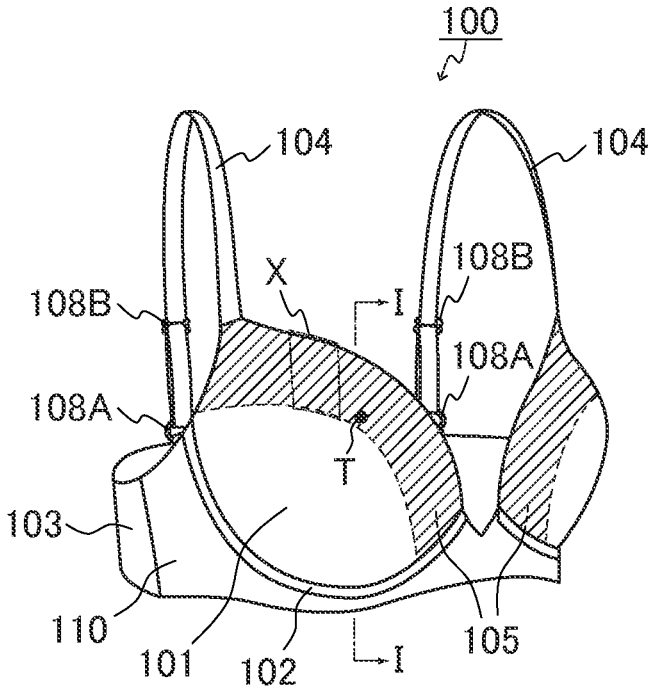
FIG. 1 is a perspective view showing a brassiere 100 according to a first embodiment of the present invention.

FIG. 1 shows a brassiere 100 according to a first embodiment of the present invention. FIG. 1 is a perspective view of the brassiere 100.

The brassiere 100 of the present embodiment is a so-called ¾ cup brassiere that includes: a pair of cup sections 101 and a back section 103. In the present embodiment, a pair of cup support sections 102 are attached to the lower edges of the pair of cup sections 101, and the back section 103 is arranged on the lateral sides of the cup support sections 102. In the present embodiment, the cup support sections 102 are each provided with a wire (not shown). A base section 110 is provided under the lower edges of the cup support sections. Also, in the present embodiment, the brassiere 100 further includes a pair of shoulder straps 104. The cup section 101 of the brassiere 100 of the present embodiment are formed of a material superior in anti-drape stiffness, which does not change much in shape when, for example, it is pressed, so that the cup sections can maintain their shapes when the garment is not worn. The material superior in anti-drape stiffness may be a nonwoven fabric, a hardly stretchable urethane material, or the like, for example.

In the present invention, each cup section 101 includes an upper breast retaining section 105 arranged between a front-center-side upper edge portion and a lateral-side upper edge portion on the inner side of the cup section. The upper breast retaining section 105 is formed so as to cover at least part of an upper breast region positioned obliquely upward to a lateral side relative to a nipple and apply a pressing force to the part. The term "upper breast" as used herein refers to a part of a breast above the nipple. In the present embodiment, the upper breast retaining section 105 is stretchable.

Figure 2A:
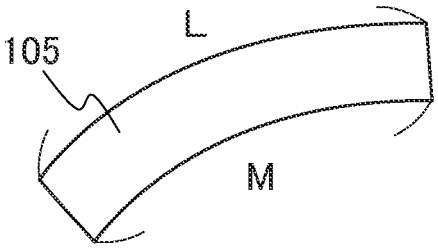
FIG. 2A shows an upper breast retaining section in the brassiere 100 of the first embodiment.
Figure 2B:
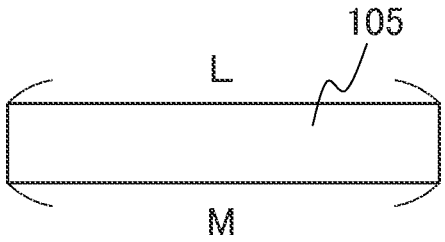
FIG. 2B shows another example of the upper breast retaining section.

FIG. 2 shows the upper breast retaining section 105. As shown in FIG. 2, in the present embodiment, the upper breast retaining section 105 has an upper edge L and a lower edge M. The terms "upper" and "lower" used in this context mean the upper and lower sides in the state where the brassiere is worn. In the present embodiment, the upper breast retaining section 105 is attached on the inner side of the cup section 101 in such a manner that at least part of the lower edge M is separate (released) from the cup section 101. Thus, between the upper edge L-side and the lower edge M side, the lower edge M side of the upper breast retaining section 105 is more liable to be displaced toward the cup section 101 (i.e., so as to be closer to the inner-side surface of the cup section). In the present embodiment, as shown in FIG. 2A, the upper and lower edges L and M of the upper breast retaining section 105 are arched so as to conform to the curve of the cup section 101. However, in the present invention, the upper breast retaining section is not limited thereto. For example, as shown in FIG. 2B, at least one of the upper and lower edges L and M may be linear when the cup section 101 has a gentle curve or depending on the specifications or the like of the cup section. In this case, the upper breast retaining section may be configured so that a member such as a patch cloth is folded over on the lower-edge side to cause the folded portion to form the lower edge M, thereby allowing the part on the lower edge M side to provide better touch on a wearer's skin.

Figure 3:
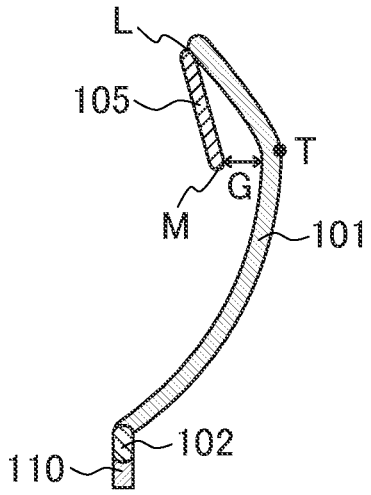
FIG. 3 is a sectional view of a cup section of the brassiere 100 of the first embodiment, viewed along arrows I-I in FIG. 1.

The arrangement of the upper breast retaining section will be described specifically below. FIG. 3 is a sectional view of the cup section 101 of the brassiere 100 according to the present embodiment, viewed along arrows I-I in FIG. 1. As shown in FIG. 3, in the present embodiment, the upper edge L of the upper breast retaining section 105 is attached to the upper edge of the cup section 101, and the lower edge M of the upper breast retaining section 105 is arranged so as to be released state from the cup section 101 at a certain distance G. With this configuration, when a wearer puts her breasts into the cup sections 101 at the time of wearing the brassiere 100, the upper breast retaining sections 105 come in close contact with the breasts. As shown in FIG. 3, the distance G increases from the upper edge L toward the lower edge M of the upper breast retaining section 105.

Accordingly, the upper edge L side of the upper breast retaining section 105 is less liable to move if it is pushed toward the cup section 101, whereas the lower edge M side of the upper breast retaining section 105 is liable to be displaced toward the cup section 101. In the present embodiment, the upper edge L of the upper breast retaining section 105 is sewn on the upper edge of the cup section 101. It is to be noted, however, that the present invention is not limited thereto, and the method for attaching the upper edge L to the cup section is not particularly limited.

In the case where the cup sections are formed of a material superior in anti-drape stiffness so that the cup sections can maintain their shapes when the brassiere is not worn as in the present embodiment, by arranging each of the upper breast retaining sections 105 in such a manner that the upper edge L is attached to the upper edge of the cup section 101 and the lower edge M is released from the cup section 101 at a certain distance, the upper breast retaining sections come into close contact with the breasts when the brassiere is worn. As described above, the brassiere 100 of the present embodiment is a ¾ cup brassiere. In general, in ¾ cup brassieres, cup sections are often formed of a material superior in anti-drape stiffness as in the present embodiment so that the cup sections can maintain their shapes when the brassieres are not worn.

On the other hand, for example, when the cup sections are formed of a stretchable material such as stretch lace, the arrangement of the upper breast retaining sections may be the same as described above. However, the present invention is not limited thereto, and the lower edges of the upper breast retaining sections may be arranged along the cup sections, instead of being released from the cup sections at a certain distance. An example where the cup sections are formed of a stretchable material will be described below.

Figure 4:
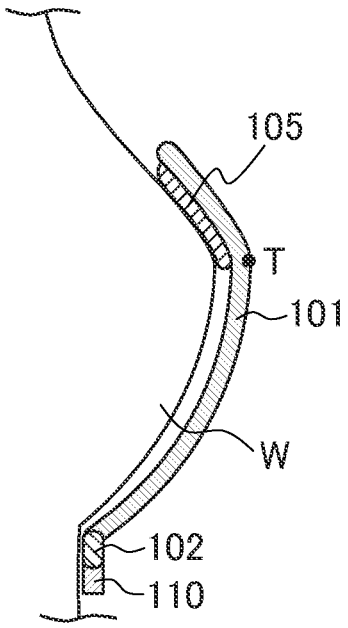
FIG. 4 is a drawing for illustrating an effect of the upper breast retaining sections.

FIG. 4 is a drawing for illustrating an effect of the upper breast retaining sections in the present embodiment. FIG. 4 is a sectional view of the cup section 101 in the state where the brassier is worn, viewed along arrows I-I in FIG. 1. As shown in FIG. 4, when a wearer put her breasts W into the cup sections 101, with the above-described configuration that the upper breast retaining sections 105 are provided on the inner side of the cup sections 101 with the upper edges L being fixed to the upper edges of the cup sections 101 and the lower edges M being released from the cup sections 101 at a certain distance G, the upper breast retaining sections 105 are pressed by the breasts W, whereby the upper breast retaining sections 105 come in close contact with the breasts W. As a result, a pressing force is applied to parts of the breasts W in close contact with the upper breast retaining sections 105. Also, in the present embodiment, the upper breast retaining sections 105 are stretchable. Thus, when they are stretched by being pressed by the breasts W, they generate a restoring force to return to their original state. This restoring force acts as the pressing force to press the breasts W against the body of the wearer. In the present embodiment, as shown in FIG. 3, the distance G on the lower edge M side of the upper breast retaining section 105 is longer than the distance G on the upper edge L side of the upper breast retaining section 105. Thus, the lower edge M side of the upper breast retaining section 105 is more liable to be displaced toward the cup section 101. On the other hand, because the lower edge M is not sewn on the cup section 101, the pressing force to press the breasts W against the body generated in the state where the brassiere is worn is greatest in an intermediate portion and reduces gradually toward the upper and lower edges.

Figure 7A:
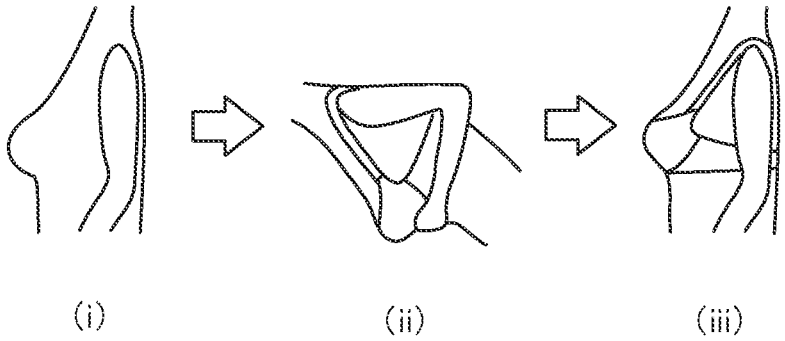
FIGS. 7A to 7C are drawings for illustrating a preferable manner to wear the brassiere 100 of the first embodiment.

Next, a preferable manner to wear the brassiere 100 of the first embodiment will be described. First, FIG. 7A illustrates a general method of wearing a brassiere. As shown in (i) and (ii) in FIG. 7A, when a wearer with her breasts being naked wears a brassiere, the wearer bends forward temporarily. The wearer in this posture connects right and left parts of the back section (which generally are referred to as "wings") on her back, and then put the right and left breasts into the cup sections while adjusting the positions of the breasts with hands. This operation also may be referred to as a "putting-in operation" of the breasts into the cup sections. After the putting-in operation is completed, the wearer returns to the upright position (see (iii) in FIG. 7A). Thus, an operation of wearing the brassiere is completed.

Figure 7B:
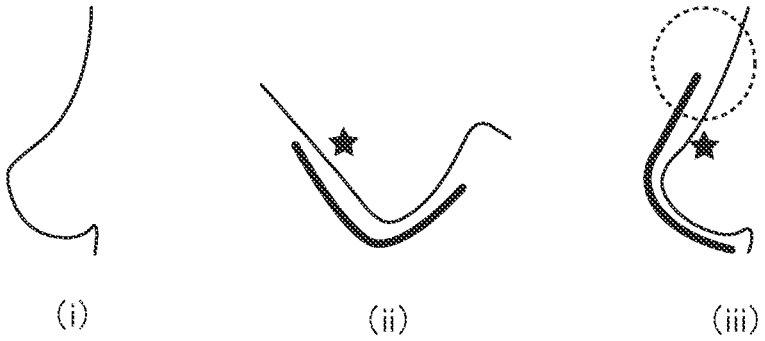
Figure 7C:
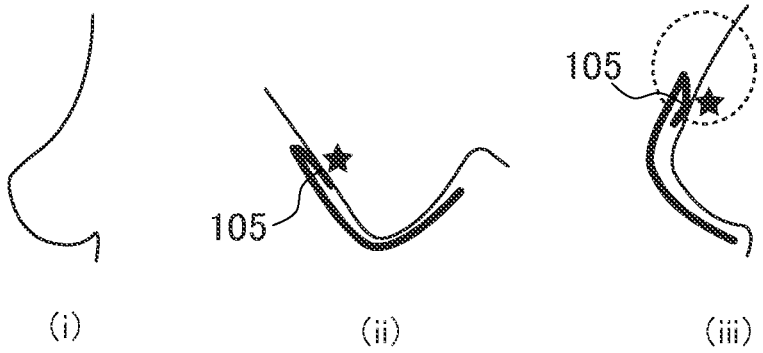

FIG. 7B schematically shows the state of a breast and a cup section during an operation of putting breasts into cups of a conventional brassiere. FIG. 7C schematically shows the state of a breast and the cup section during an operation of putting breasts into the cup sections of the brassiere 100 according to the present embodiment. As shown in (ii) in FIG. 7B, at the time of wearing the conventional brassiere, an upper breast part (a portion indicated with a star in FIG. 7B) is not in close contact with an upper edge portion of the cup section during an operation of putting the breast into the cup section while bending forward. Thus, the upper edge portion of the cup section is separated from the upper part of the breast when the wearer returns to the upright position (see (iii) of FIG. 7B).

In contrast, in the case of the brassiere 100 according to the present embodiment, an upper part of the breast is in close contact with the upper breast retaining section 105 during the operation of putting the breasts in the cup sections, as shown in (ii) in FIG. 7C. When the wearer bends forward as shown in the drawing, the upper parts of the breasts to be in contact with the upper breast retaining sections 105 become larger as compared with those in the naked state, and the upper breast retaining sections 105 then come into close contact with these enlarged upper breast parts with the upper breast retaining sections 105 slightly biting into the upper breast parts. At this time, the pressing force applied to the breast by each upper breast retaining section 105 is greatest in an intermediate portion, as described above. Then, when the wearer returns to the upright position, because the upper breast retaining sections 105 are in close contact with the upper parts of the breasts while pressing the upper parts of the breasts (see (iii) in FIG. 7C), the state where the breasts are enhanced when the wearer was in the bending forward posture is maintained, whereby the state where the upper breasts have fullness can be achieved. On this account, at the time of wearing the brassiere 100 according to the present embodiment, if a wearer bends forward deeply to the extent that the upper half of the body is substantially horizontal when she takes the above-described bending-forward posture, it is possible to achieve the state where the upper breasts have ample fullness. The state where the upper breasts have fullness also can be achieved if a wearer bends forward slightly to the extent that the upper half of the body inclines forward at an angle of about 30° to 45°. However, if the state where the upper breasts have ample fullness is desired, it is preferable to perform the putting-in operation while bending forward deeply as described above. The present embodiment is directed to an example where a wearer performs the putting-in operation of the breasts while bending forward. However, for example, if a wearer wears the brassiere 100 while lifting up her breasts with hands to keep the state where upper parts of the breasts have fullness without bending forward, it is also possible to obtain the same effect as that in the case where the putting-in operation is performed in the above-described manner. As described above, according to the brassiere 100 of the present invention, the state where breasts are enhanced, obtained when a wearer took a bending-forward posture, can be maintained even if the wearer is in an upright position. Therefore, even pendulous breasts can be shaped so as to have fullness in upper parts of the breasts.

In the present embodiment, each of the upper breast retaining sections 105 is formed so that, in the state where the brassiere 100 is worn, the upper breast retaining section 105 presses the following region in a breast: a region (a hatched region Y in FIG. 21B) surrounded by a first virtual vertical line passing through the nipple, a second virtual vertical line extending parallel to the first virtual vertical line at a distance of 3 cm from the first virtual vertical line on the lateral side of the first virtual vertical line, a first virtual horizontal line extending above the nipple at a distance of 3 cm from the nipple, and a second virtual horizontal line extending above the first virtual horizontal line at a distance of 3 cm from the first virtual horizontal line. In the present embodiment, the position X surrounded by a square composed of a two-dot chain line in FIG. 1 corresponds to a portion to be in contact with and pressing the region Y. As described above, by lifting up at least part of the region Y, it is possible to lift up entire breasts effectively. Therefore, by arranging each upper breast retaining section at the position X to be in contact with this region Y, at least part of the region Y can be lifted up by the upper breast retaining section, whereby entire breasts can be lifted up effectively. That is, in the state where the brassier is worn, the upper breast retaining sections 105 are in close contact with at least part of the region Y while pressing the part, whereby the state where the entire breasts are lifted up can be maintained effectively with the pressing force applied to the upper parts of the breasts. It is to be noted, however, that the present invention is not limited thereto, and the upper breast retaining sections are not limited as long as they are each arranged between a front-center-side upper edge portion and a lateral-side upper edge portion on an inner side of the cup section, so as to cover at least part of an upper breast region positioned obliquely upward to a lateral side relative to a nipple.

Although the present embodiment is directed to an example where part of the region Y is pressed by each of the upper breast retaining sections 105, the present invention is not limited thereto. For example, the position X may be set so that each of the upper breast retaining sections 105 presses part of a region Y' defined by a first virtual horizontal line $\alpha'$ extending above the nipple at a distance of 2 cm from the nipple, a second virtual horizontal line $\beta'$ extending above the first virtual horizontal line $\alpha'$ at a distance of 4 cm from the first virtual horizontal line $\alpha'$, and the same first virtual vertical line $\alpha$ and the second virtual vertical line $\beta$ as those for defining the region Y. Also with this configuration, it is possible to obtain the same effect as in the case of the brassiere 100 according to the present embodiment. Which of the region Y and the region Y' should be pressed by each of the upper breast retaining sections may be determined as appropriate with consideration given to specifications of the product, such as the shape of the cup sections of the brassiere, for example.

Figure 5:
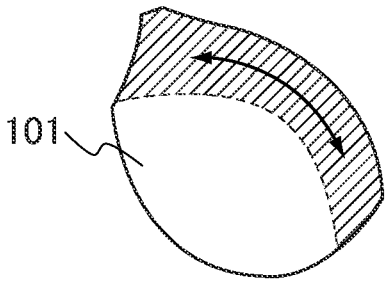
FIG. 5 shows the cup section of the brassiere 100 of the first embodiment, viewed from the inner side.
Figure 6:
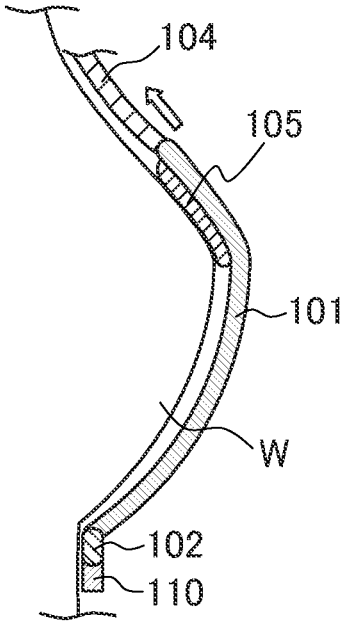
FIG. 6 is a drawing for illustrating an effect of a shoulder strap.

In the present embodiment, the upper breast retaining sections 105 are formed of a stretchable material. Examples of the stretchable material include coarse materials such as a power net fabric, other stretchable materials, and so-called free-cutting materials, which do not require a process for preventing raveling. FIG. 5 shows the cup section 101 viewed from the inner side. Because the upper breast retaining sections 105 are formed of a stretchable material, the upper breast retaining sections 105 are stretched by being pressed by breasts, as shown in FIG. 5. When the upper breast retaining sections 105 are stretched, they generate a restoring force to return to their original state. With this restoring force, the breasts are held as if they were caught by every single stitch or undulation on a fabric surface of the upper breast retaining sections 105. Thus, the upper breast retaining sections 105 as a whole can hold the breasts firmly.

Also, by changing the structure or the like of some parts of the upper breast retaining sections, the upper breast retaining sections may be adapted so as to exhibit different stretching degree depending on the position therein. For example, the upper breast retaining sections each may be adapted so that a portion corresponding to the position X exhibits a large stretching degree and other portions exhibit stretching degrees lower than that of the portion corresponding to the position X. It is to be noted, however, that, in the present invention, the upper breast retaining sections are not limited as long as they are formed so as to press at least part of the upper breast region as described above, and it is not always necessary that they are formed of a stretchable material.

In the present invention, it is preferable that the upper breast retaining sections are mesh members. With this configuration, friction resistance is generated between the upper breast retaining sections and breasts, whereby the upper breast retaining sections are less liable to be displaced by slipping. Accordingly, it is possible to maintain the fullness at a higher position in breasts more effectively.

In the present embodiment, each of the upper breast retaining sections 105 is arranged so as to cover a nipple, and the lower edge M is not sewn on the cup section 101. Thus, a force pressing the breast is greatest in an intermediate portion between the lower edge M and the upper edge L. In FIGS. 1, 3, and 4, the site indicated with T is the position corresponding to the nipple in the cup section 101. With this configuration, it is possible to apply a greater pressing force to breasts as compared with the case where the upper breast retaining sections 105 press the breasts evenly. Thus, the state where the breasts are enhanced can be kept for a long time more easily. It is to be noted, however, that the present invention is not limited thereto. As described above, the upper breast retaining sections are not limited as long as they are each arranged between a front-center-side upper edge portion and a lateral-side upper edge portion on an inner side of the cup section, so as to cover at least part of an upper breast region positioned obliquely upward to a lateral side relative to a nipple. In the present embodiment, the distance G between the lower edge M and the cup section preferably is set, for example, in the range from 0.5 cm to 3 cm, more preferably in the range from 1 cm to 2 cm.

In the present invention, the width of each upper breast retaining section in the vertical direction is not particularly limited, and preferably is such that the lower edge is at a position to allow a nipple to be at least partially covered with the upper breast retaining section. More preferably, the width is such that the lower edge of each upper breast retaining section covers the nipple completely, because this allows the breasts to be held firmly.

According to the brassiere 100 of the present embodiment, it is possible to provide a swelling extending to the vicinity of the third rib, for example. When a swelling is provided in the vicinity of the third rib, a well-rounded and youthful bust silhouette can be achieved. In the present embodiment, the brassiere 100 has the shoulder straps 104, as described above. With this configuration, as indicated with a white arrow in FIG. 6, an uplifting power generated by the shoulder straps 104 enhances the adhesion between the upper breast retaining sections 105 and breasts, whereby out-of-shape wearing can be inhibited for a long time. It is to be noted, however, that, in the present invention, shoulder straps are not essential components. The present invention also is applicable to a strapless brassiere having detachable shoulder straps.

Figure 8A:
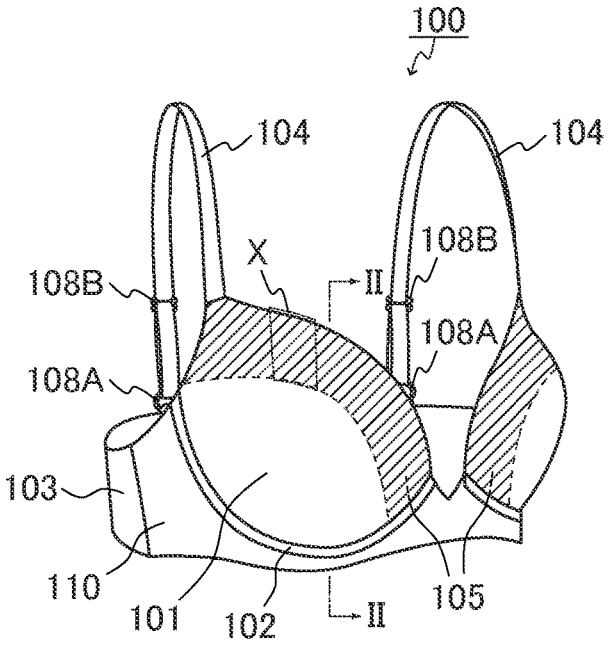
FIGS. 8A and 8B show another example of the brassiere 100 of the first embodiment.
Figure 8B:
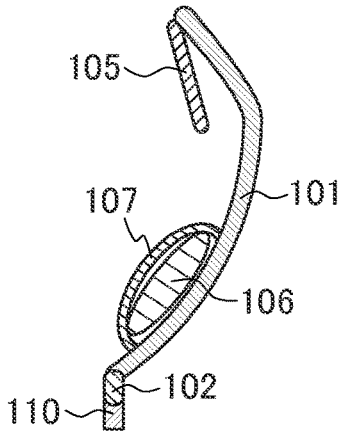

The present invention may be used in combination with pads. In this case, the method for attaching the pads is not particularly limited, and conventional methods for attaching pads may be used. FIG. 8 shows an example where the brassiere 100 of the present embodiment is used in combination with pads 106. FIG. 8A is a perspective view of the present example, and FIG. 8B is a sectional view of the cup section 101 viewed along arrows II-II in FIG. 8A. In the present example, the pad 106 is inserted in a pocket 107 provided on the inner side of the cup section 101. By using the brassiere 100 in combination with the pads as in the present example, breasts can be supported by the pads from below while maintaining the state where upper parts of the breasts have fullness. Therefore, the breasts can be lifted up more effectively.

In the brassiere of the present example, a hook closure (e.g., a hook-and-eye closure) can be used as an engagement fastening section of the back section 103. Other kinds of engagement fastening devices also may be used. It is not always necessary that the back section 103 has the engagement fastening section. For example, the present invention may be a brassiere of a front closure type with the engagement fastening section being provided in the front center. Alternatively, the present invention may be a brassiere without the engagement fastening section or a brassiere with parts of the back sections to be fastened by tying them together.

As the engagement fastening section, for example, a hook closure (e.g., a hook-and-eye closure), a gripper, a button, a cord, a hook-and-loop fastener, or the like can be selected and used as appropriate according to the design or use of the brassiere. When the above-described hook-and-eye closure, gripper, or button is used, it is preferable to provide a plurality of locking positions in advance so as to allow fine adjustment of the degree of fastening. Other kinds of engagement fastening devices also may be used.

In the present embodiment, one end of the shoulder strap 104 is attached directly to the cup section 101, and the other end of the shoulder strap 104 is attached to the upper edge portion of the back section 103 with an engagement device 108A. Also, a length adjuster 108B is attached to the shoulder strap 104. The shoulder strap 104 is attached to the upper edge portion of the back section 103 in the following manner: the other end of the shoulder strap 104 is passed through the engagement device 108A, turned around, and then introduced into the length adjuster 108B. As the engagement device, a circular ring, a Z ring, an eight-shaped ring, or the like can be used, for example. As the length adjuster, an eight-shaped ring, a circular ring, or the like can be used, for example. One end of the shoulder strap 104 may be attached to an upper part of the cup section 101 with the engagement device, and the other end of the shoulder strap may be fixed directly to the upper edge portion of the back section 103. The form of the shoulder straps 104 is not limited thereto. For example, a so-called "halter neck" type strap(s) connecting the upper parts of the pair of cup sections 101 may be employed. The attachment positions of the shoulder straps 104 can be determined as appropriate according to the shape of the cup sections 101 or the design of the brassiere. The shoulder straps 104 are not particularly limited as long as they allow the cup sections 101 to be suspended from a wearer's shoulders. For example, the shoulder straps 104 may be formed of cords or fabric tapes, or may be so-called "round type" straps, which are wide straps as used in a tank top. The present invention is not limited to an embodiment where the pair of shoulder straps 104 are attached to the pair of cup sections 101 in one-to-one correspondence with the ends of each shoulder strap being attached to an upper part of the cup section 101 and to the back section 103. For example, like shoulder straps as used in a sports type brassiere, two shoulder straps 104 may be integrated on the back side, and this integrated strap may be attached to the back section 103.

In the present embodiment, the shoulder straps 104 are connected to lateral-side portions of the upper breast retaining sections 105. It is to be noted, however, that, in the present invention, the positions to which the shoulder straps are connected are not limited thereto. When the brassiere is a ¾ cup brassiere as in the present embodiment, the shoulder straps may be connected at positions on the lateral sides relative to the upper breast retaining sections.

The present embodiment has been described with reference to an example where the brassiere 100 is configured so that the right and left cup support sections 102 are connected via the base section 110, and also, the cup support sections 102 are connected to the back section 103 via the base section 110. It is to be noted, however, that the present invention is not limited thereto. For example, the brassiere 100 may be a brassiere without the base section 110. More specifically, the brassiere 100 may be configured so that the back section 103 extends forward so as to be connected to the cup support sections 102 directly, and the brassiere 100 further includes a connection member for connecting front center side portions of the right and left cup support sections 102 to each other. In the brassiere 100 of the present embodiment, the cup support sections 102 are provided with wires. It is to be noted, however, that the present invention also is applicable to a wireless garment in which cup support sections are not provided with wires. The base section may be formed so that, for example, the base section also is connected to a lateral-side upper edge portion of each cup section 101, which extends between the position to which the shoulder strap 104 is connected to the cup section 101 and the lateral-side end of the cup support section 102, and the shoulder straps 104 may be connected to the base section configured as above, instead of being connected to the cup sections 101. This configuration is suitable mainly for garments with wireless cups, such as, for example, sport brassieres and brassiere-provided garments.

Although the first embodiment has been described above with reference to an example where the brassier is a ¾ cup brassiere, the present invention is not limited thereto. The present invention also is applicable to a full cup brassiere, a half-cup brassiere, or the like, for example.

(Objective Wearing Evaluation 1)

The brassieres 100 of the present embodiment were produced, and a wearing evaluation test was conducted. The brassieres 100 were provided with pads, as in the example shown in FIG. 8. As a material of the upper breast retaining sections 105, a power net mesh fabric was used.

Figure 18A:
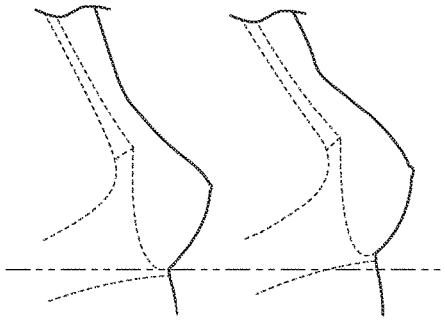
FIGS. 18A and 18B show the shapes of breasts observed in a wearing evaluation test.
Figure 18B:
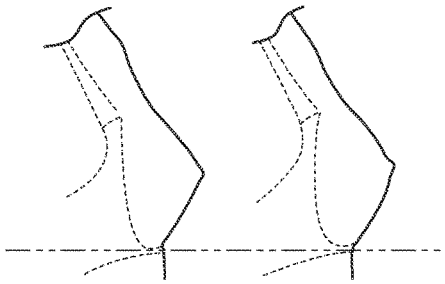

FIG. 18 shows the results of infrared photography of the bust silhouettes of a test user with large breasts and a test user with small breasts from the side in the state where they wore the brassiere 100 or a conventional brassiere provided with pads. In the present evaluation test, in order to make the bust silhouettes more intelligible, the brassiere 100 and the conventional brassiere both had transparent cup sections. In FIG. 18, illustration of the cup sections is omitted. FIG. 18A shows the result obtained regarding the test user with large breasts, and FIG. 18B shows the result obtained regarding the test user with small breasts. In each of FIGS. 18A and 18B, the drawing on the left shows the result obtained when the test user wore the conventional brassiere, and the drawing on the right shows the result obtained when the test user wore the brassiere 100 of the present invention.

First, with reference to FIG. 18A, it can be seen that, when the test user with large breasts wore the conventional brassiere, although lower parts of the breasts were lifted up, upper parts of the breast still lacked fullness and remained deflated. In contrast, when the test user wore the brassiere 100 of the present embodiment, the bust silhouette of the test user was such that a swelling was formed so as to extend from the upper to lower parts of the breasts in favorable balance like a breast shape in water, and the upper parts of the breasts were well-rounded. Also, the position of the breasts when the brassiere 100 of the present embodiment was worn was higher than the position of the breasts when the conventional brassiere was worn. Next, with reference to FIG. 18B, it can be seen that, when the test user with small breasts wore the conventional brassiere, upper parts of the breasts also still remained deflated. In contrast, when the test user wore the brassiere 100 of the present embodiment, the state of the breasts of the test user was such that a swelling was formed so as to extend from the upper to lower parts of the breasts in favorable balance like a breast shape in water, and the upper parts of the breasts were well-rounded as compared with the case where the test user with small breasts wore the conventional brassiere, as in the case of the example shown in FIG. 18A. Also, the position of the breasts when the brassiere 100 of the present embodiment was worn was higher than the position of the breasts when the conventional brassiere was worn. These results demonstrate that the brassiere 100 of the present embodiment can lift up entire breasts to a higher position and provide fullness in upper parts of breasts, regardless of breast size.

(Objective Wearing Evaluation 2)

The brassieres 100 of the present embodiment were produced, and a wearing evaluation test was conducted. The brassieres 100 were provided with pads, as in the example shown in FIG. 8. As a material of the upper breast retaining sections 105, a power net mesh fabric was used.

Figure 19:
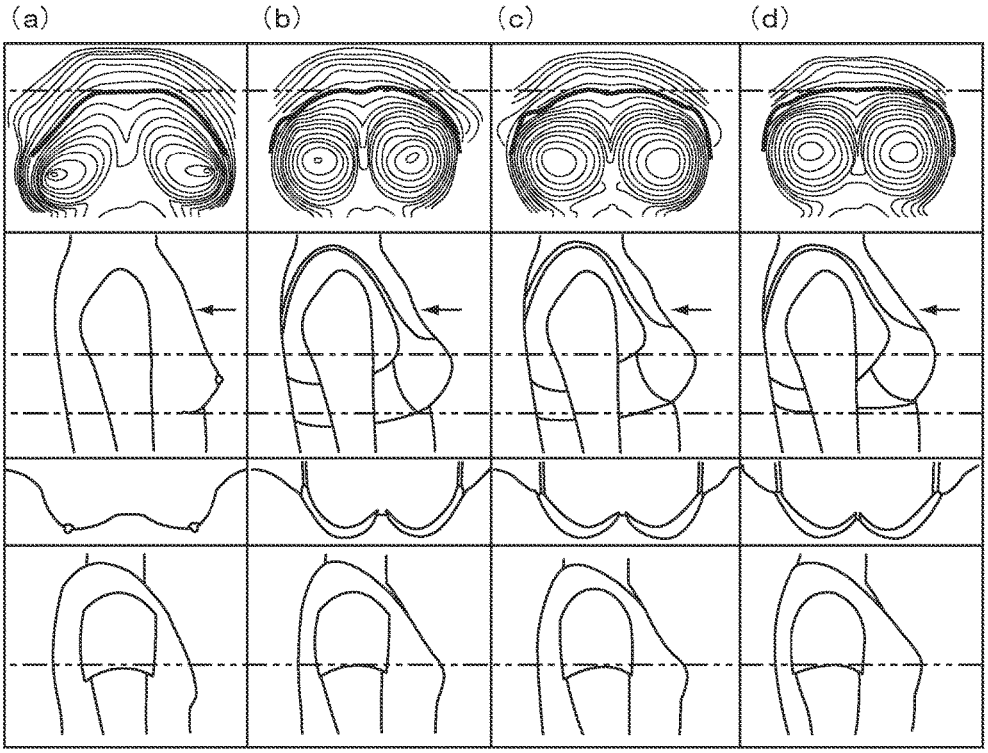
FIG. 19 shows, in (a) to (d), the shapes of breasts observed in another wearing evaluation test.

FIG. 19 shows the results of photographing the chest part of the same test user with a breast size C70 wearing the brassiere 100, a conventional brassiere A, or a conventional brassiere B after she conducted exercise simulating the daily living activities and then indicating the three-dimensional shape of the breasts by moiré interference fringes as contour lines. The brassiere A and the brassiere B were conventional brassieres having an effect of enhancing pendulous breasts. In FIG. 19, (b) shows the result obtained regarding the conventional brassiere A, (c) shows the result obtained regarding the conventional brassiere B, and (d) shows the result obtained regarding the brassiere 100 of the present embodiment. In each of (b) to (c), the first row shows the result of photographing the chest part from the front, the second row shows the result of photographing the chest part from the side, the third row shows the result of photographing the chest part from above, and the fourth row shows the result of photographing the chest part from the side in the state where the test user wore a T-shirt. In FIG. 19, (a) shows the naked state of the same test user. The two-dot chain line shown in the first row in FIG. 19 indicates the position of the third rib. The two two-dot chain lines shown in the second row in FIG. 19 are inserted to assist comparison of the position of the nipple and comparison of the position of the brassiere, and an arrow indicates the position of the third rib. The two-dot chain line shown in the fourth row in FIG. 19 is inserted to assist comparison of the position of the nipple.

First, comparison of the results shown in the first row in FIG. 19 revealed that, when the brassiere 100 of the present embodiment was worn, the breasts were lifted up to a higher position, as compared with the case where the conventional brassieres A and B were worn. Also, it can be seen that, when the brassiere 100 of the present embodiment was worn, the gap between the contour lines in the vicinity of the third rib was narrower than those in the case where the conventional brassieres A and B were worn. This demonstrates the presence of swelling in the vicinity of the third rib. Furthermore, it can be seen that, when the brassiere 100 of the present embodiment was worn, little inclination (i.e., deflated fullness) was observed on the lateral sides of the upper breasts. Next, comparison of the results shown in the second row in FIG. 19 revealed that fullness in the upper breasts was deflated when the conventional brassieres A and B were worn, whereas the upper breasts had fullness when the brassiere 100 of the present embodiment was worn. It also can be seen that, when the brassiere 100 of the present embodiment was worn, the breasts were lifted up to a higher position, and the swelling extended up to the position of the third rib. Furthermore, when the brassiere 100 of the present embodiment was worn, the position of the nipples and the under bust position were higher than those in the case where the conventional brassieres A and B were worn. Next, comparison of the results shown in the third row in FIG. 19 revealed that the brassiere 100 of the present embodiment can provide a bust silhouette protruding forward, which is comparable to those achieved by the conventional brassieres A and B. Next, comparison of the results shown in the fourth row in FIG. 19 revealed that, when the conventional brassieres A and B were worn, the breasts lacked fullness owing to deflated fullness in the upper breast, whereas the brassiere 100 of the present embodiment provided a bust silhouette having ample fullness with well-rounded upper breasts. These results demonstrate that the brassiere 100 of the present embodiment can lift up entire breasts to a higher position and can shape breasts having fullness in upper parts of the breasts. Furthermore, according to the brassiere 100 of the present embodiment, even after conducting the exercise as described above, the breasts were shaped with the nipples being maintained at a high position, as compared with the other brassieres. This demonstrates that, according to the brassiere 100 of the present embodiment, out-of-shape wearing during exercise is less liable to occur.

(Subjective Wearing Evaluation)

The brassieres 100 of the present embodiment were produced, and a wearing evaluation test was conducted. The brassieres 100 were provided with pads, as in the example shown in FIG. 8. As a material of the upper breast retaining sections 105, a power net mesh fabric was used. Test users were made up of eight women in their late 30's to 50's, whose breasts had become pendulous owing to advancing age. The breast sizes of the test users were as follows: large (three test users); medium (two test users); and small (three test users). Furthermore, as comparative examples, the same eight test users also wore the above-described brassieres A and B.

As a result, seven out of the eight test users commented that the brassiere 100 of the present embodiment exhibited a stronger breast-enhancing effect than the brassiere A, and five out of the eight test users commented that the brassiere 100 of the present embodiment exhibited a stronger breast-enhancing effect than the brassiere B. Furthermore, all the eight test users commented that the brassiere 100 of the present embodiment provided a youthful bust silhouette closer to the one they desired as compared with the brassiere A, and seven out of the eight test users commented that the brassiere 100 of the present embodiment provided a youthful bust silhouette closer to the one they desired as compared with the brassiere B. Also, regarding the brassiere 100 of the present embodiment, the following comments were obtained: "a well-rounded silhouette with ample fullness was provided in a part extending from the neck to the breasts", "even after the exercise, the upper breasts still had fullness at a high position", "the breasts themselves were lifted up", "the nipples were at a high position", and "the breasts were at a high position". From these results, it was found that the brassiere 100 of the present embodiment can lift up entire breasts high and provide fullness in upper parts of the breasts.

Second Embodiment

Figure 9:
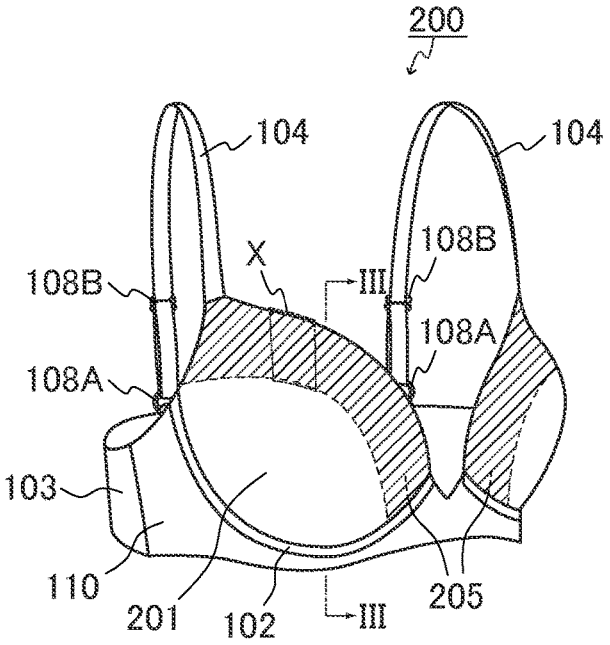
FIG. 9 is a perspective view showing a brassiere 200 of a second embodiment of the present invention.

FIG. 9 shows a brassiere 200 according to a second embodiment of the present invention. FIG. 9 is a perspective view of the brassiere 200.

Figure 10:
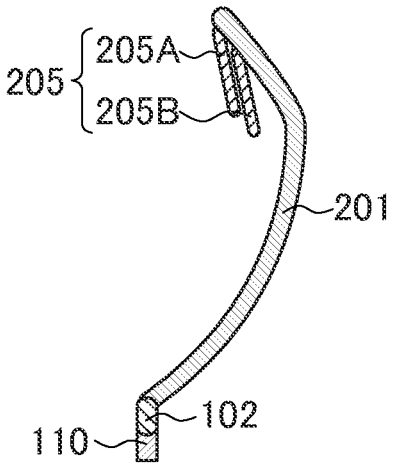
FIG. 10 is a sectional view showing a cup section of the brassiere 200 of the second embodiment, viewed along arrows III-III in FIG. 9.

FIG. 10 is a sectional view showing a cup section 201, viewed along arrows III-III in FIG. 9. As shown in FIG. 10, in the brassiere 200 of the present embodiment, an upper breast retaining section 205 is composed of two components, namely, an upper breast retaining section 205A and an upper breast retaining section 205B wider than the upper breast retaining section 205A. As shown in FIG. 10, in the present embodiment, the upper breast retaining section 205A is arranged on the inner side of the upper breast retaining section 205B. In the present embodiment, the upper edges of the upper breast retaining sections 205A and 205B are each fixed to the upper edge of the cup section 201, and the lower edges of the upper breast retaining sections 205A and 205B are each released from the cup section 201. Other configurations are the same as those in the first embodiment. With this configuration of the upper breast retaining section 205, the upper edge side of the upper breast retaining section 205 has a dual structure. Thus, the upper edge side of the upper breast retaining section 205 can apply a stronger pressing force, thereby allowing breasts to be held more firmly.

Third Embodiment

Figure 11:
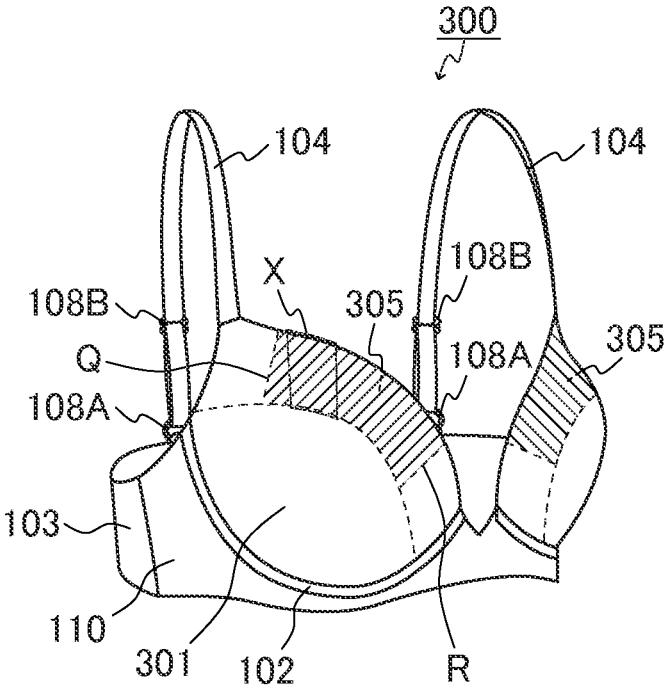
FIG. 11 is a perspective view showing a brassiere 300 of a third embodiment of the present invention.

FIG. 11 shows a brassiere 300 according to a third embodiment of the present invention. FIG. 11 is a perspective view of the brassiere 300.

As shown in FIG. 11, in the present embodiment, each of upper breast retaining sections 305 is arranged not on an entire upper part of the cup section 301 but on a part of the upper part of the cup section 301. In the present embodiment, the upper breast retaining section 305 is arranged so that, in the state where the brassiere 300 is worn, the upper breast retaining section 305 is in a region including a position X to be in contact with the following region in a breast so as to extend astride an upper part of a nipple: a region surrounded by a first virtual vertical line passing through the nipple, a second virtual vertical line extending parallel to the first virtual vertical line at a distance of 3 cm from the first virtual vertical line on the lateral side of the first virtual vertical line, a first virtual horizontal line extending above the nipple at a distance of 3 cm from the nipple, and a second virtual horizontal line extending above the first virtual horizontal line at a distance of 3 cm from the first virtual horizontal line. Also, in the present embodiment, side edges Q and R on the right and left sides of the upper breast retaining section 305 are fixed to the cup section 301. The term "right and left" as used in this context may refer to the positions when viewed either from the front or from the back. Other configurations are the same as those in the first embodiment. As described above, in the present invention, the upper breast retaining sections are not limited as long as they are each arranged between a front-center-side upper edge portion and a lateral-side upper edge portion on an inner side of the cup section, so as to cover at least part of an upper breast region positioned obliquely upward to a lateral side relative to the nipple, and the regions in which the upper breast retaining sections are arranged can be determined as appropriate depending on a bust silhouette intended to be achieved, the design of the brassiere, etc.

Although the present embodiment is directed to an example where the side edge R is fixed to an upper-edge-side portion closer to the front center in the cup section 301, the present invention is not limited thereto. For example, according to the specifications of the cup section 301, the side edge R of the upper breast retaining section 305 may be connected to the cup support section 102. Furthermore, although the present embodiment is directed to an example where the side edge Q is fixed to an upper-edge-side portion of the cup section 301 closer to the lateral side, the present invention is not limited thereto. For example, according to the specifications of the cup section 301, the side edge Q of the upper breast retaining section 305 may be connected to the cup section 301 in the vicinity of the lateral-side end of the cup support section 102.

Fourth Embodiment

Figure 12:
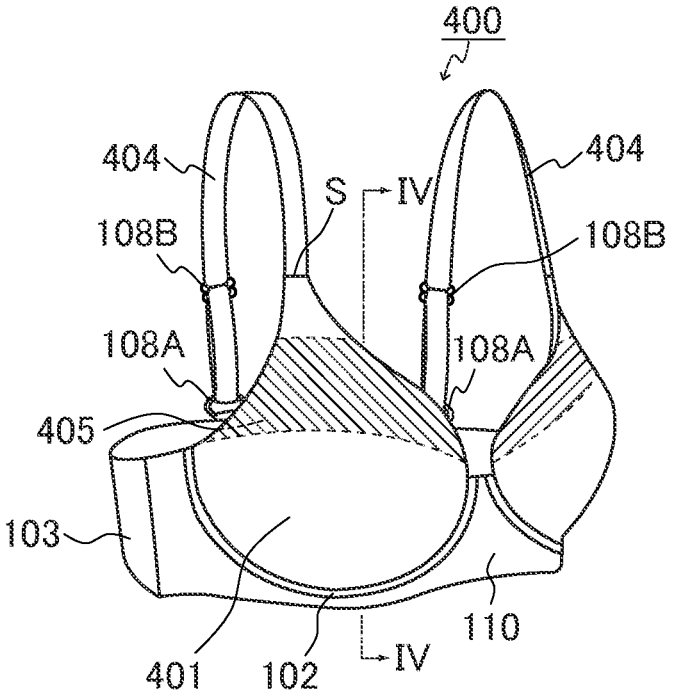
FIG. 12 is a perspective view showing a brassiere 400 of a fourth embodiment of the present invention.

FIG. 12 shows a brassiere 400 according to a fourth embodiment of the present invention. FIG. 12 is a perspective view of the brassiere 400. The brassiere 400 of the present embodiment is a so-called full cup brassiere. Cup sections 401 of the brassiere 400 of the present embodiment are formed of a stretchable material such as stretch lace, for example.

Figure 13:
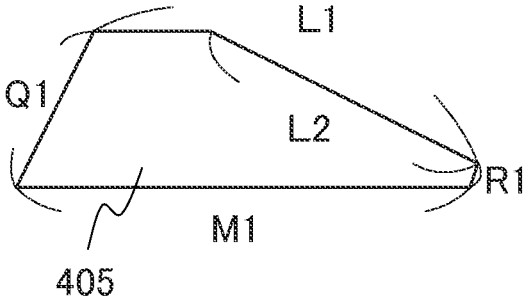
FIG. 13 shows an upper breast retaining section of the brassiere 400 of the fourth embodiment.

FIG. 13 shows an upper breast retaining section 405 in the present embodiment. As shown in FIG. 13, the upper breast retaining section 405 in the present embodiment has an upper edge L1, a lower edge M1, a lateral-side side edge Q1, and a front-center-side side edge R1.

Figure 14:
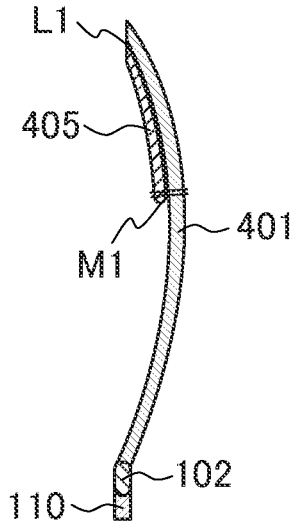
FIG. 14 is a sectional view showing a cup section of the brassiere 400 of the fourth embodiment, viewed along arrows IV-IV in FIG. 12.

The arrangement of the upper breast retaining section 405 in the present embodiment will be described below. FIG. 14 is a sectional view showing a cup section 401 of the brassiere 400 of the present embodiment, viewed along arrows IV-IV in FIG. 12. First, as shown in FIG. 12, the front center side L2 of the upper edge L1 of the upper breast retaining section 405 is attached to the front-center-side upper edge of the cup section 401, and the lateral-side side edge Q1 is attached to the lateral-side upper edge of the cup section 401. The method for attaching the front center side L2 of the upper edge L1 and the lateral-side side edge Q1 to the cup section 401 is not particularly limited. In the present embodiment, they are attached by being sewn on the cup section 401. In the present embodiment, any part other than L2 in the upper edge L1 is not fixed to the cup section 401. However, the present invention is not limited thereto, and the entire upper edge L1 may be fixed to the cup section. As shown in FIG. 14, the lower edge M1 of the upper breast retaining section 405 is arranged along the cup section 401 without any distance between the lower edge M1 and the cup section 401, and is attached to the cup section 401. In the present embodiment, the lower edge M1 of the upper breast retaining section 405 is fixed to the cup section 401 by being sewn on the cup section 401.

Figure 15A:
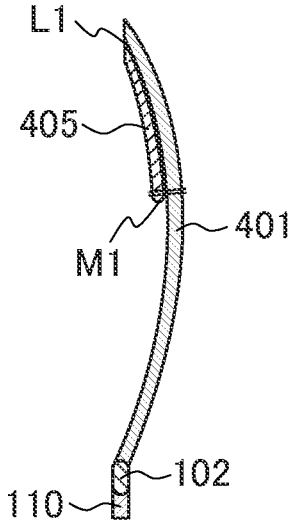
FIGS. 15A and 15B are drawings for illustrating an effect of the upper breast retaining section in the fourth embodiment.
Figure 15B:
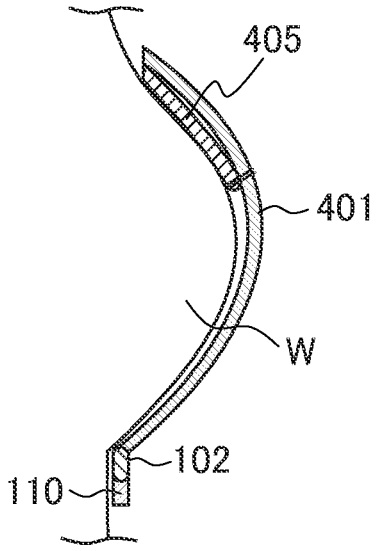

FIG. 15 shows drawings for illustrating an effect of the upper breast retaining section in the present embodiment. FIG. 15A and FIG. 15B are sectional views each showing the cup section 401, viewed along arrows IV-IV in FIG. 12. FIG. 15A shows the state before the brassiere is worn, and FIG. 15B shows the state where the brassiere is worn. First, as shown in FIGS. 15A and 15B, when a wearer put her breasts W into the cup sections 401, the cup sections 401 fit the shape of the breasts, because the cup sections 401 are formed of a stretchable material. Thus, the upper edge portions of the cup sections 401 are pressed by the breasts W, whereby the upper edge portions come in close contact with the breasts W. Consequently, the upper breast retaining sections 405 also come in close contact with the breasts W. As a result, a pressing force is applied to portions of the breasts W in close contact with the upper breast retaining sections 405. In the present embodiment, because the upper breast retaining sections 405 are stretchable, when they are stretched by being pressed by the breasts W, they generate a restoring force to return to their original state. With this restoring force, the breasts W can be pressed and held firmly.

At the time of wearing the brassiere 400 of the present embodiment, it is preferable that a wearer puts her right and left breasts into cup sections while bending forward. This allows the upper breast retaining sections 405 to come in close contact with the breasts in the state where the upper breasts have ample fullness and also allows this state to be maintained. However, for example, when a wearer wears the brassiere 400 while lifting up her breasts with hands to provide fullness in the upper parts of the breasts, instead of bending forward, it is also possible to obtain the same effect as that in the case where the putting-in operation is performed.

In the present embodiment, the lower edges M1 of the upper breast retaining sections 405 are fixed to the cup sections 401. When the cup sections are stretchable as in the present embodiment, the lower edges of the upper breast retaining sections may be fixed to the cup sections. In the present embodiment, the lower edges M1 are fixed to the cup sections 401 by being sewn on the cup sections 401, as described above. However, the method for fixing the lower edges M1 is not particularly limited. Also, the present invention is not limited to the present exemplary embodiment, and even in the case where the cup sections are stretchable, it is not always necessary that the lower edges of the upper breast retaining sections are fixed to the cup sections.

Figure 16A:
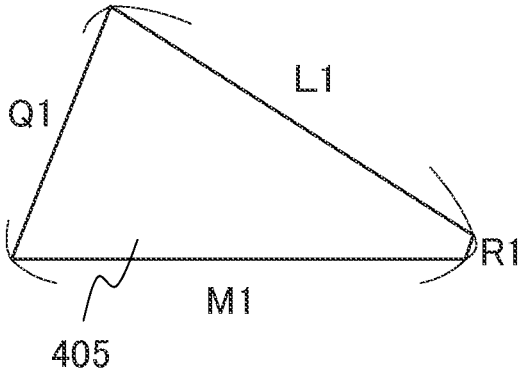
FIGS. 16A and 16B show another example of the fourth embodiment.
Figure 16B:
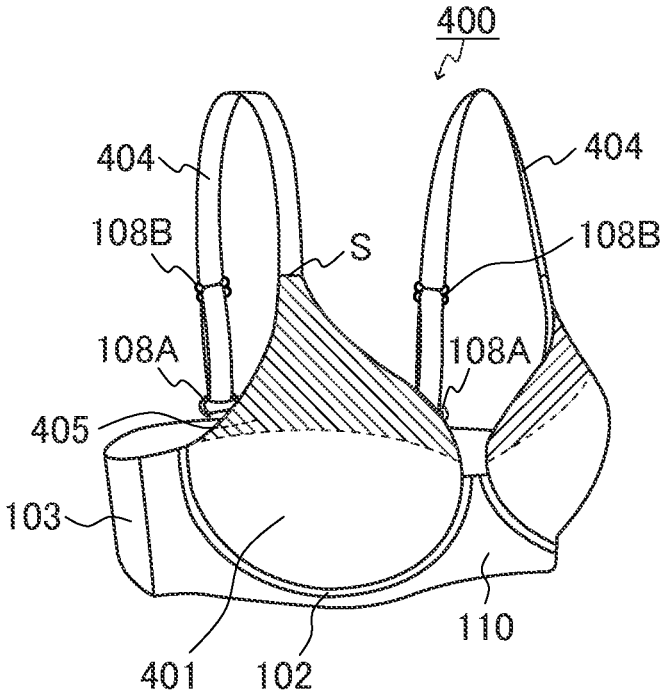

In the present embodiment, it is preferable that each of the shoulder straps 404 is connected to the cup section 401 above the upper breast retaining section 405. In the present embodiment, as shown in FIG. 12, the upper breast retaining section 405 may be provided below the attachment position S of the shoulder strap 404 to the cup section 401 with a certain gap from the attachment position S. The "certain gap" is not particularly limited as long as the upper breast retaining section 405 is arranged below the attachment position S of the shoulder strap 404 to the cup sections 401. It is to be noted, however, that the present invention is not limited thereto. FIG. 16 shows another example of the present embodiment. In the present invention, for example, the upper breast retaining sections 405 may each have a substantially triangular shape as shown in FIG. 16A, and as shown in FIG. 16B, the shoulder straps may be connected to the upper edges of the upper breast retaining sections.

In the present embodiment, any stretchable material can be used for the cup sections 401 without particular limitation. Examples of the material include stretch lace and power net fabrics.

The present embodiment is directed to a full cup brassiere with cup sections formed of a stretchable material, configured so that the lower edges of the upper breast retaining sections are arranged along the cup sections. It is to be noted, however, that the present invention is not limited thereto, and even when the cup sections are formed of a stretchable material, the lower edges of the upper breast retaining sections may be arranged so as to be released from the cup sections as in the first to third embodiments.

Fifth Embodiment

Figure 17B:
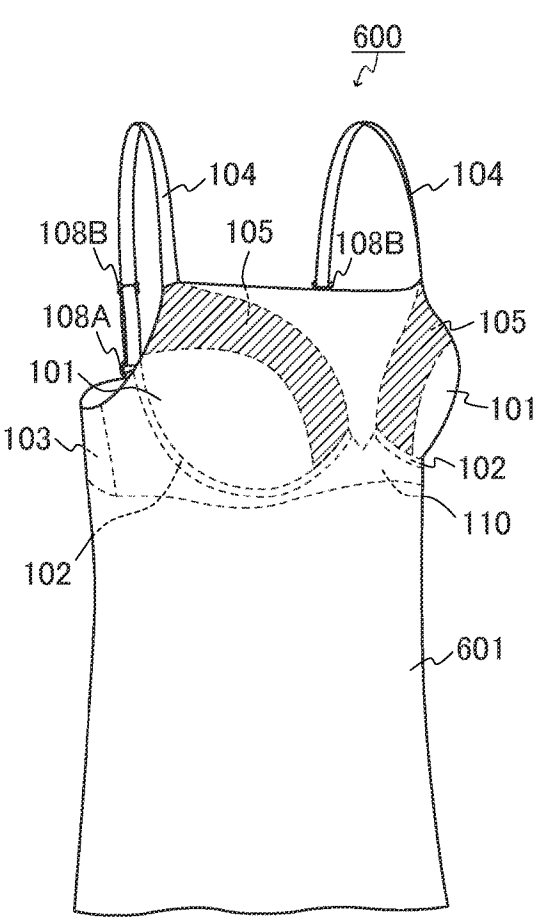
FIG. 17B is a perspective view showing a brassiere-provided camisole 600 according to a sixth embodiment of the present invention.
Figure 17A:
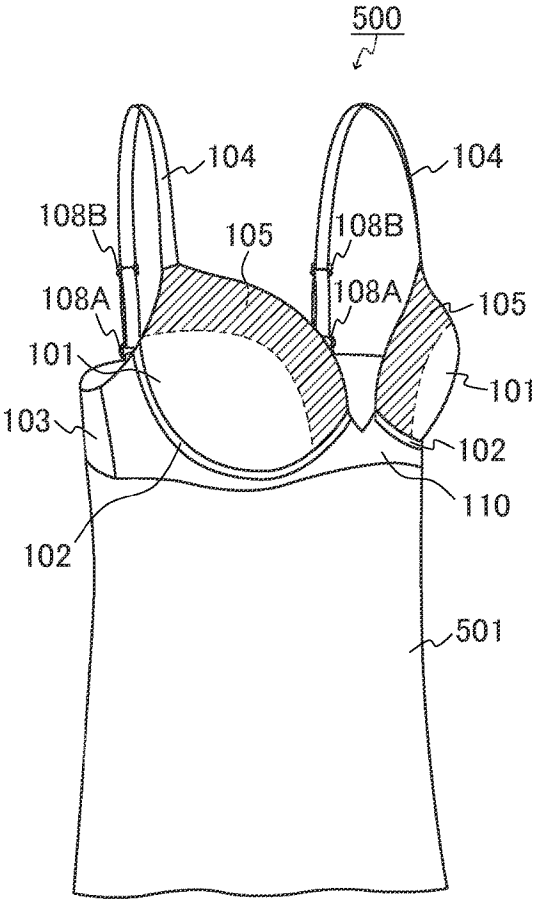
FIG. 17A is a perspective view showing a brassiere-provided camisole 500 according to a fifth embodiment of the present invention.

FIG. 17A is a perspective view of a brassiere-provided camisole 500 as an embodiment of the present invention other than a brassiere.

The brassiere-corresponding part of the brassiere-provided camisole 500 of the present embodiment is substantially the same as the brassiere 100 shown in FIG. 1. The brassiere-provided camisole 500 of the present embodiment has a bodice 501 provided below a base section 110. In the present embodiment, a back section is provided separately, and the bodice 501 is provided below the back section. However, the bodice 501 may also serve as a back section. The present embodiment is directed to a brassiere-provided camisole having a brassiere-corresponding part that is substantially the same as the brassiere 100 of the first embodiment. It is to be noted, however, that the present invention is not limited thereto, and the brassiere-provided camisole may have a brassiere-corresponding part according to any other embodiment of the present invention.

Sixth Embodiment

FIG. 17B is a perspective view showing a brassiere-provided camisole 600 as an embodiment of the present invention other than a brassiere. The brassiere-provided camisole 600 of the present embodiment has a bodice 601 provided so as to cover the brassiere-corresponding part. In the present embodiment, a back section 103 does not have an engagement fastening section, and the brassiere-provided camisole 600 can be put on and taken off without operating the engagement fastening section. Other configurations of the brassiere-corresponding part are substantially the same as those in the brassiere 100 shown in FIG. 1. With the configuration of the present embodiment, it is possible to increase variations of the appearance when the camisole is worn, regardless of the design of the cup sections 101. Also, the cup sections 101 can be made more inconspicuous via any clothes worn on the camisole. The present embodiment is directed to a brassiere-provided camisole having a brassiere-corresponding part that is substantially the same as the brassiere 100 of the first embodiment. It is to be noted, however, that the present invention is not limited thereto, and the brassiere-provided camisole may have a brassiere-corresponding part according to any other embodiment.

The present invention has been described above with reference to embodiments thereof, namely, brassieres and brassiere-provided camisoles. It is to be noted, however, the garment with cup sections according to the present invention is not limited to these exemplary embodiments, and can be embodied in various forms. For example, the present invention is applicable not only to foundation garments such as those described in the above embodiments, but also to bodysuits, brassiere-provided slips, swimsuits, leotards, tank tops with cups, and other various garments with cup sections.

INDUSTRIAL APPLICABILITY

The garment with cup sections according to the present invention can lift up entire breasts to a higher position and thus can attain improved breast-shaping properties. There is no limitation on the use of the garment, and the garment can be used in a broad range of fields.

While the present invention has been described above with reference to the exemplary embodiments, the present invention is by no means limited thereto. Various changes and modifications that may become apparent to those skilled in the art may be made in the configuration and specifics of the present invention without departing from the scope of the present invention.

This application claims priority from Japanese Patent Application No. 2013-073213 filed on Mar. 29, 2013. The entire disclosure of this Japanese patent application is incorporated herein by reference.

EXPLANATION OF REFERENCE NUMERALS

100, 200, 300, 400: brassiere (garment with cup sections)
101, 201, 301, 401: cup section
102: cup support section
103: back section
104, 404: shoulder strap
105, 205, 305, 405: upper breast retaining section
108A: (circular ring) engagement device
108B: length adjuster
110: base section
500, 600: brassiere-provided camisole
501, 601: bodice
L, L1: upper edge of upper breast retaining section
M, M1: lower edge of upper breast retaining section
G: distance

The invention claimed is:

1. A garment with cup sections, comprising:
a pair of cup sections; and
a back section,
wherein the back section is arranged on lateral sides of the pair of cup sections,
each of the cup sections comprises an upper breast retaining section arranged between a front-center-side upper edge portion and a lateral-side upper edge portion on an inner side of the cup section,
the upper breast retaining section is formed so as to cover at least part of an upper breast region positioned obliquely upward to a lateral side relative to a nipple and apply a pressing force to the part, and
a front center side of an upper edge of the upper breast retaining section is entirely attached to an upper edge of the cup section.

2. The garment according to claim 1, wherein
each of the upper breast retaining sections is formed by attaching the stretchable material to an inner side of the cup section.

3. The garment according to claim 1, wherein
the cup sections are formed of a material superior in anti-drape stiffness so that the cup sections can maintain their shapes when the garment is not worn, and
each of the upper breast retaining sections is formed by attaching a stretchable material to the inner side of the cup section in such a manner that at least part of a lower edge of the upper breast retaining section is separated from the cup section.

4. The garment according to claim 1, further comprising a pair of shoulder straps,
wherein each of the shoulder straps is connected to the cup section by being attached to a lateral-side portion of the upper breast retaining section or at a position on a lateral side relative to the upper breast retaining section.

5. The garment according to claim 1, further comprising a pair of shoulder straps, wherein each of the shoulder straps is connected to the cup section above the upper breast retaining section.

6. The garment according to claim 1, wherein each of the upper breast retaining sections is formed so that, in the state where the garment is worn, the upper breast retaining section presses at least part of a region in a breast surrounded by:

a first virtual vertical line passing through the nipple;

a second virtual vertical line extending parallel to the first virtual vertical line at a distance of 3 cm from the first virtual vertical line on the lateral side of the first virtual vertical line;

a first virtual horizontal line extending above the nipple at a distance of 2 cm from the nipple; and a second virtual horizontal line extending above the first virtual horizontal line at a distance of 4 cm from the first virtual horizontal line.

7. The garment according to claim 1, wherein each of the upper breast retaining sections comprises a mesh member.

8. The garment according to claim 1, wherein the garment is a brassiere.

* * * * *